US006701067B2

(12) United States Patent
Naylor

(10) Patent No.: US 6,701,067 B2
(45) Date of Patent: Mar. 2, 2004

(54) VAPOR PHASE HEATERS

(75) Inventor: Geoffrey Naylor, MacClesfield (GB)

(73) Assignee: Rieter ICBT, Valence (FR)

( * ) Notice: Subject to any disclaimer, the term of this patent is extended or adjusted under 35 U.S.C. 154(b) by 0 days.

(21) Appl. No.: 10/247,802

(22) Filed: Sep. 19, 2002

(65) Prior Publication Data

US 2003/0123862 A1 Jul. 3, 2003

(30) Foreign Application Priority Data

Sep. 22, 2001 (GB) ..... 0122885

(51) Int. Cl.[7] ..... A61M 33/06
(52) U.S. Cl. ..... 392/394; 122/478
(58) Field of Search ..... 392/394, 395, 392/401, 484; 122/32, 235.12, 483, 478; 165/162

(56) References Cited

U.S. PATENT DOCUMENTS 3,602,201 A * 8/1971 Baillie ..... 122/478
3,745,978 A * 7/1973 Armand ..... 122/483
4,120,350 A * 10/1978 Norton ..... 165/162
4,184,455 A * 1/1980 Talmud et al. ..... 122/4 D
4,208,987 A * 6/1980 Chaix et al. ..... 122/32
4,473,035 A * 9/1984 Gorzegno ..... 122/235.12
5,063,609 A * 11/1991 Lorimer ..... 392/401
5,307,802 A * 5/1994 Placek ..... 126/600
5,388,180 A * 2/1995 Bayles ..... 392/484
5,467,424 A * 11/1995 Davies et al. ..... 392/401
6,067,403 A * 5/2000 Morgandi ..... 392/401
6,129,043 A * 10/2000 Lai et al. ..... 118/715
6,169,852 B1 * 1/2001 Liao et al. ..... 392/395

* cited by examiner

*Primary Examiner*—Sang Y. Paik
*Assistant Examiner*—Leonid Fastovsky
(74) *Attorney, Agent, or Firm*—Dority & Manning

(57) ABSTRACT

A vapor phase heater includes a plurality of elongated hollow heater tracks. A vapor generator having a vapor generation chamber is in fluid communication with the interior of each track. At least one heat input tube extends through the vapor generation chamber wherein a vaporized fluid is supplied to the heat input tubes. A vapor flow connector communicates with the vapor generator and the interior of each track so as to provide conduits for vapor produced in the vapor generator to pass into each track.

22 Claims, 4 Drawing Sheets

VAPOR PHASE HEATERS

BACKGROUND

This invention relates to vapour phase heaters.

Vapour phase heaters are known devices which comprise a boiler in connection with one or more heater tracks. The boiler heats a heat transfer fluid so as to produce hot vapour which expands into the heater tracks. Gravity returns the condensed fluid to the boiler. Any non-condensing gases are expanded through small holes disposed at the top of the heater tracks and its pipes, which are connected to a vent box. Thus, non-condensing gases are collected in the vent box. A return tube returns the condensed heat transfer fluid from the vent box to the boiler. The arrangement enables the boiler to be commissioned or vented without using a vacuum pump.

There are a number of problems associated with such known vapour phase heaters.

Firstly, although conventional vapour phase heaters generally function perfectly well when the heater tracks are disposed in a vertical position, i.e., the longitudinal axis of a track is at 90° to the horizontal, such heaters perform less well when the tracks are at a shallower angle to the horizontal. This is because, in order to operate a vertical multitrack vapour phase heater in a satisfactory manner, the boiling action must take place in the horizontal boiler with sufficient space in the boiler for the vapour to flow freely into the tracks. At shallow angles, there is a risk that the heat transfer fluid will spill into the tracks such that there is no route for vapour to pass from the boiler to the tracks. One way of overcoming this problem would be to utilize a very high sided boiler. However, such an approach is undesirable since the boiler flat plate sections would have to be made from very thick material to withstand the high stresses resulting from such a design. Additionally, the boiler surface area would have to be increased, resulting in increased heat losses which would render the boiler less thermally efficient. In view of these problems it is perhaps not surprising that conventional multi-track heaters are generally not capable of operating at angles of less than 35° to the horizontal. However, it would be desirable to provide vapour phase heaters which are capable of operating at shallower angles still. Applications of such low angle heaters include use in filament processing machines, for example in a false twist texturing machine.

Secondly, problems are encountered when a large number of heater tracks are utilized. As the number of heater tracks utilized in a vapour phase heater is increased, the width of the boiler must be increased in order to accommodate them. Conventionally, the boiler comprises a heat input tube extending across the width of the boiler. In such a configuration, high expansion stresses are encountered during rapid temperature increases which necessitates the use of expensive high quality components.

Thirdly, stability problems are often encountered due to "hot spots" on the heat input tubes which produce an expanding bubble of vapour within the fluid. The effect of the vapour bubble expanding and eventually collapsing is to cause uncontrolled oscillations in temperature. This problem is common to both single and multi-track vapour phase heaters.

The present invention overcomes the above described problems, and provides improved vapour phase heaters.

SUMMARY

Objects and advantages of the invention will be set forth in part in the following description, or may be obvious from the description, or may be learned through practice of the invention.

According to a first aspect of the invention there is provided a vapour phase heater comprising:

A plurality of elongated, hollow heater tracks;

A vapour generator having a vapour generation chamber in fluid flow communication with the interior of each track at a lower end of each track;

At least one heat input tube extending through the vapour generation chamber;

A fluid vaporizable by heat supplied through the heat input tubes; and

Vapour flow connector means communicating with the vapour generator and the interior of each track at a location removed from the lower end of the track so as to provide conduits for vapour produced in the vapour generator to pass into each track.

The provision of the vapour flow connector means provides a passage for heated vapour to pass to the heater tracks even if there is no such passage for vapour flow from the vapour generator into the lower ends of the tracks which are in fluid flow communication with the vapour generator chamber. This permits the vapour phase heater to be used at shallow angles with respect to the horizontal, even though at shallow angles the fluid may be horizontally displaced in vapour generation chamber to such an extend that the fluid has flowed into the lower end of the tracks and thereby blocked passage of heated vapour from the vapour generation chamber to said lower ends. Angles as low as 5° to 10° to the horizontal can be accommodated with such an arrangement.

The vapour flow connection means may comprise a plurality of vapour flow connection tubes, each vapour flow connection tube directly communicating with the interior of a track and the vapour generator.

The vapour phase heater may be adapted for use in operation configurations in which the angle of the tracks relative to the horizontal can range between 90° and at least 30°, preferably 10°, most preferably 5°, the vapour generation chamber being disposed at the lower end so that in any operating condition fluid condensed in each track is returned to the vapour generation chamber by gravity. The quantity of fluid may be such that the heat input tubes are continuously covered with fluid accumulated in the vapour generation chamber when the heater is in any operation configuration but also such that a vapour collection space remains free of fluid within the chamber, said vapour collection space being in communication with the vapour flow connector means.

The vapour generator may comprise a plurality of section, wherein:

Each section has an associated heat input tube or tubes which are separate from those of the other section or sections; and Each section is in fluid flow communication with a different set of tracks.

In this way, the expansion stresses resulting from increases in temperature are reduced, because an individual heat input tube only extends across a single section, rather than the entire width of the vapour generator. As a result, low cost, robust heater elements can be used safely.

A vapour flow communication path may be provided between vapour collection spaces of different sections. The vapour flow communication path may contain, but not be filled by, fluid in any of the operation configurations.

The vapour generator may comprise two sections.

A gas collecting chamber may be provided to collect non-condensing gases, the gas collecting chamber being in flow communication with the ends of the tracks spaced from the vapour generator. A fluid return may be provided between the gas collecting chamber and the vapour generation chamber. The fluid return may be provided with a trap to prevent vapour flow from the vapour generation chamber to the gas collecting chamber.

The wall of the vapour generation chamber opposite the tracks may be curved to converge with the lower ends of the tracks.

Each track may have a front face with a pair of thread receiving grooves, the other track faces being insulated. The grooves may have a spacing in the range of 10 to 15 mm, preferably about 12 mm.

The surfaces of the heat input tubes within the vapour generation chamber may be provided with a heat distribution wrapping to limit the size of vapour bubbles created at each point on the tube surface. This permits operation of the device at lower temperatures than would otherwise be possible.

It has been found that the wrapping provides a significant reduction in problems associated with "hot spots". Preferably, the heat distribution wrapping comprises a braiding, such as a steel braiding.

The heat input tubes may be arranged in a single row adjacent the tracks.

The heat input tubes may receive electrical heater elements, which can be inserted from and removed by way of the ends of the tubes.

The number of tracks associated with the vapour generator may be in the range of four to eight, preferably six.

According to a second aspect of the invention there is provided a vapour phase heater comprising:

A plurality of elongated, hollow heater tracks;

A vapour generator having a vapour generation chamber in fluid flow communication with the interior of each track at a lower end of the track;

At least one heat input tube extending through the vapour generation chamber; and A fluid vaporizable by heat supplied through the heat input tube, in which the vapour generator comprises a plurality of sections, and wherein:

Each section has an associated heat input tube or tubes which are separate from those of the other section or sections; and Each section is in fluid flow communication with a different set of tracks.

According to a third aspect of the invention there is provided a vapour phase heater comprising:

At least one, elongated hollow heater track;

A vapour generator having a vapour generation chamber in fluid flow communication with the interior of each track at a lower end of the track;

At least one heat input tube extending through the vapour generation chamber; and A fluid vaporizable by heat supplied through the heat input tubes;

In which the surfaces of the heat input tubes within the vapour generating chamber are provided with a heat distribution wrapping to limit the size of vapour bubbles created at each point on the tube surface.

BRIEF DESCRIPTION OF THE DRAWINGS

Embodiments of vapour phase heaters in accordance with the invention will now be described with reference to the accompanying drawings, in which.

DETAILED DESCRIPTION

Reference will now be made in detail to embodiments of the invention, examples of which are shown in the figures. The embodiments are provided by way of explanation of the invention, and not as a limitation of the invention. It is intended that the present invention include modifications and variations to the embodiments shown and described herein.

Figure 1:
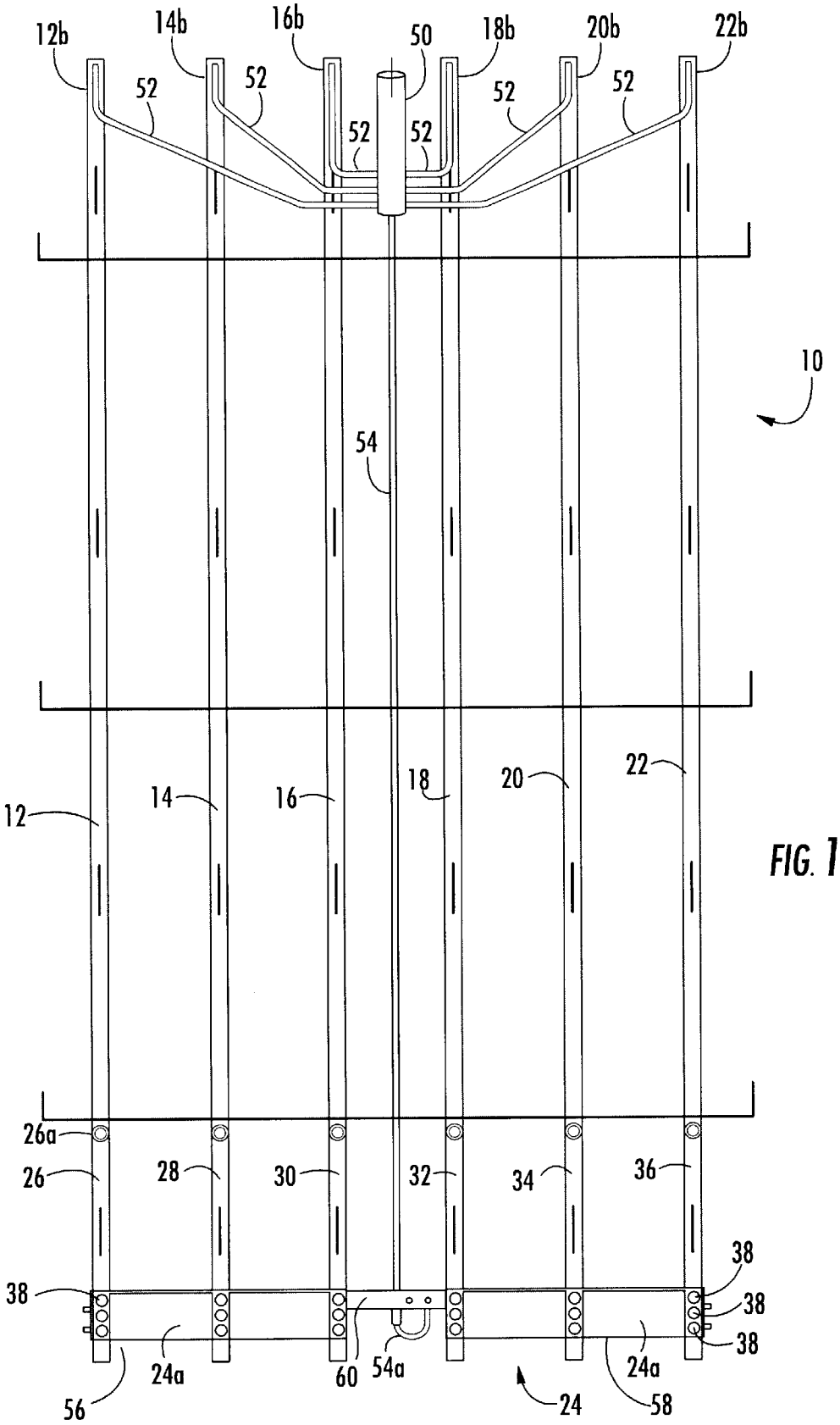
FIG. 1 is a back view of a vapour phase heater.

FIG. 1 shows a back view of a vapour phase heater (shown generally at 10) of the present invention comprising:

A plurality of elongated, hollow heater tracks, 12, 14, 16, 18, 20, 22; and A vapour generator 24 having a vapour generation chamber 24*a* in fluid flow communication with the interior of each track 12, 14, 16, 18, 20, 22 at a lower end of each track.

Not shown in FIG. 1 are a plurality of heat input tubes extending through the vapour generation chamber 24, and a fluid vaporizable by heat supplied through the heat input tubes. The vapour phase heater further comprises vapour flow connector means 26, 28, 30, 32, 34, 36 communicating with the vapour generator 24 and the interior of each track 12, 14, 16, 18, 20, 22 at a location (for example, the location denoted 26*a* in FIG. 1) removed from the lower end of the track so as to provide conduits for vapour produced in the vapour generator 24 to pass into each track 12, 14, 16, 18, 20, 22.

As shown in FIG. 1, the vapour flow connector means comprises a plurality of vapour flow connection tubes 26, 28, 30, 32, 34, 36, each vapour flow connection tube 26, 28, 30, 32, 34, 36 directly communicating with the interior of a track and the vapour generator 24. Other arrangements, such as a manifold arrangement, might be contemplated.

The interior of each track is in fluid flow communication with the vapour generation chamber 24*a* of the vapour generation 24 by way of a plurality of apertures 38 formed in each track, which apertures 38 are in communication with the vapour generator 24. Such apertures 38 also have the effect, particularly when the angle of the tracks with respect to the horizontal is low, of permitting the fluid itself to flow into the tracks 12, 14, 16, 18, 20, 22.

Figure 2:
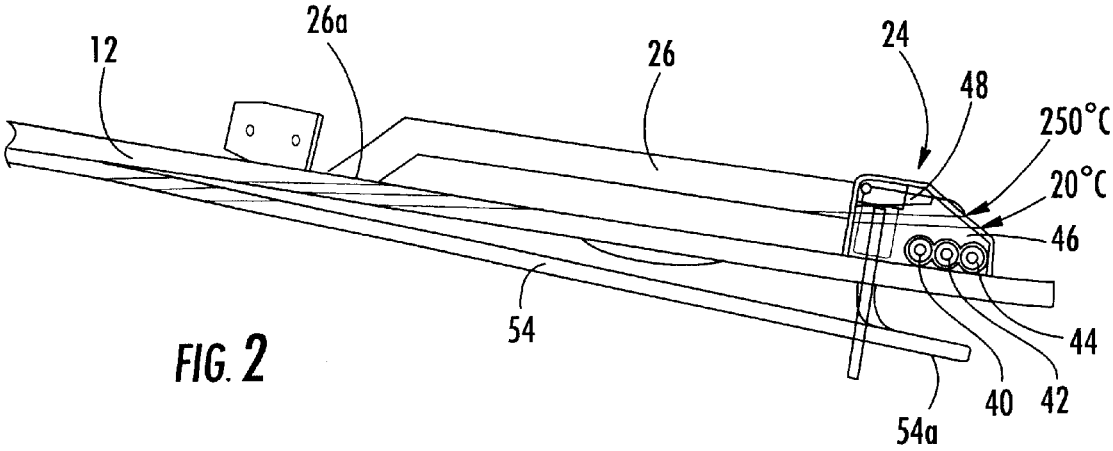
FIG. 2 is a side view of a lower portion of a vapour phase heater at a track angle of about 10°.

FIG. 2 is a side view of the heater 10. Identical numbers to those shown in FIG. 1 are used to denote shared features. The heater 10 is in an operating configuration in which the angle of the tracks with respect to the horizontal is about 10°, i.e., at a very shallow angle. In FIG. 2 can be seen the plurality of the heat input tubes 40, 42, 44. Also to be seen is the fluid 46. For presentational purposes, FIG. 2 depicts the level of the fluid 46 within the vapour generator 24 at two different temperatures of 20° and 250° C. The latter two correspond to possible operating temperatures. It can be seen that at the shallow track angle of about 10°, the level of the fluid 46 with respect to the heater 10 is such that the fluid 46 extends into the track 12. Furthermore, the fluid 46 extends into the track 12 to an extent such that there is no air gap between the vapour generator 24 and the track 12. Thus, there is no direct pathway for vapour heated in the vapour generator 24 to flow into the tracks 12, 14, 16, 18, 20, 22.

The heater of the present invention provides vapour flow connection means, which in the present embodiment, and in the context of track 12, comprises vapour flow connection tube 26. As can be seen in FIG. 2, the vapour flow connection tube 26 communicates with the vapour generator 24. Furthermore, the vapour generator 24 comprises a vapour collection space 48, which is free of fluid 46 even at the shallow track angle of 10°. Thus, vapour heated in the vapour generator 24 has a direct pathway to the vapour flow connection tube 26. The vapour flow connection tube 26 acts as a conduit for heated vapour to the track 12, the heated vapour entering the track 12 at location 26*a*. Identical considerations apply to the other tracks 14, 16, 18, 20, 22 and their associated vapour flow connection tubes 28, 30, 32, 34, 36.

The heated vapour rises in the tracks 12, 14, 16, 18, 20, 22, heating the tracks along their length. Fluid is condensed out onto the interior of the tracks and this fluid is returned to the vapour generation chamber 24*a* by gravity. However, not all of the heated vapour is condensed by contact with the interiors of the tracks 12, 14, 16, 18, 20, 22. To ensure that such non-condensing gases are not circulated or returned to the vapour generator 24, a gas collecting chamber 50 is provided (FIG. 1), the gas collecting chamber 50 being in flow communication with the ends 12*b*, 14*b*, 16*b*, 18*b*, 20*b*, 22*b* of the tracks spaced from the vapour generator 24 via gas collection tubes 52. A fluid return 54 is provided between the gas collecting chamber 50 and the vapour generation chamber 24*a*. In order to operate at shallow track angles, the fluid return 54 is provided with a trap 54*a* to prevent vapour flow from the vapour generation chamber 24*a* to the gas collecting chamber 50.

The present invention also provides a split boiler to enable low cost, robust elements to be used. Thus the vapour generator at FIG. 1 comprises two sections 56, 58. The provision of further sections is within the scope of the invention. The first section 56 has associated heat input tubes 40, 42, 44 (not shown in FIG. 1 but shown in FIG. 2). The second section 58 has a different set of associated heat input tubes. The unit section 56 is in fluid flow communication with tracks 12, 14, 16, whilst the second section 58 is in fluid flow communication with tracks 18, 20, 22. The first 56 and second 58 sections are linked by a vapour flow communication path 60. The vapour flow communicator path 60 contains, but is not filled by, fluid at any of the operating angles accommodated by the heater 10. The fluid return 54 feeds into the vapour flow communication path 60. A further improvement is provided by the provision of steel braiding around the heat input tubes. It has been found that the braiding reduces the occurrence of "hot spots" on the tubes.

Figure 3:
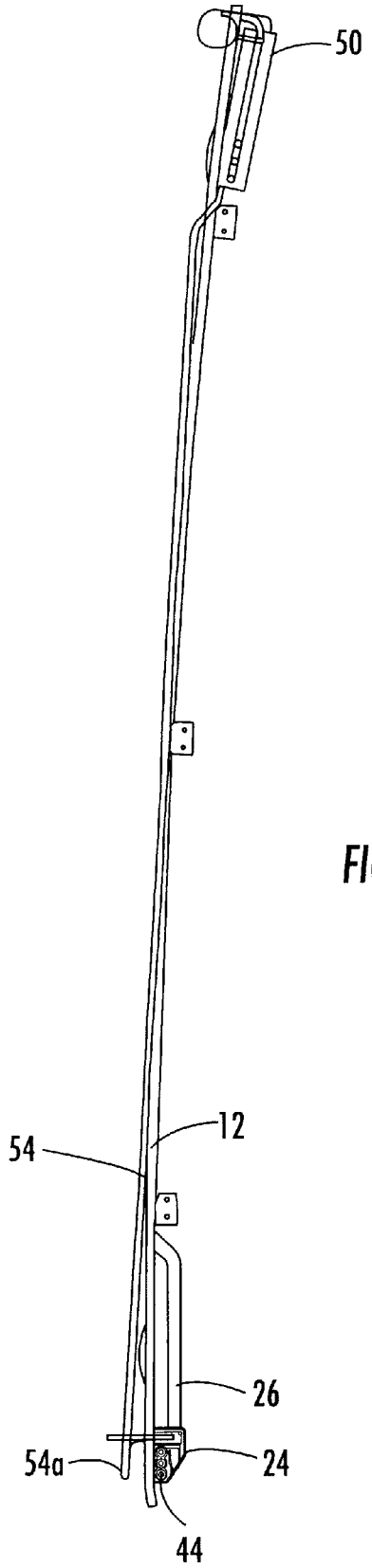
FIG. 3 is a side view of a vapour phase heater at a track angle of nearly 90°.
Figure 4:
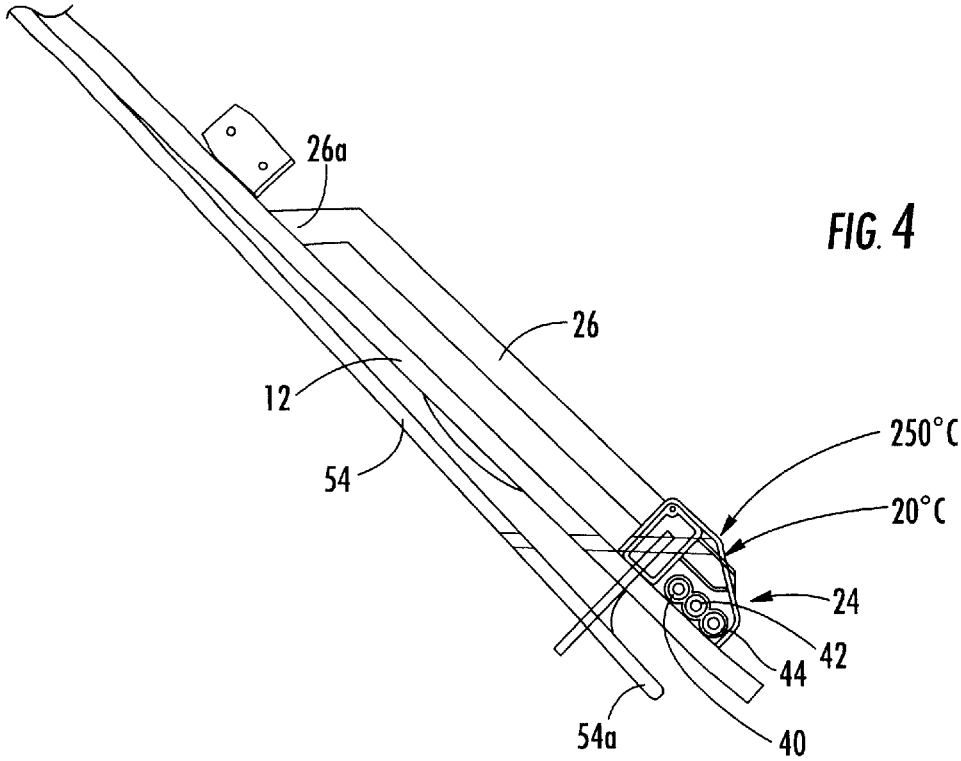
FIG. 4 is a side view of a lower portion of a vapour phase heater at a track angle of about 45°.
Figure 5:
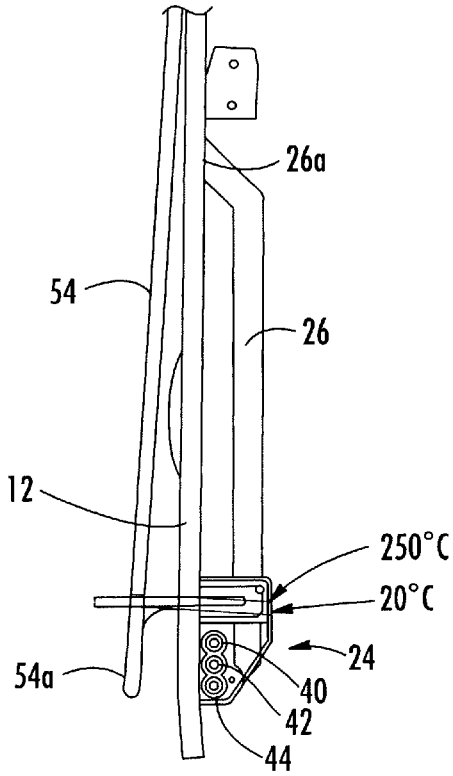
FIG. 5 is a side view of a lower portion of a vapour phase heater at a track angle of nearly 90°.

FIG. 3 shows a side view of the heater 10 along its entire length. FIGS. 4 and 5 show side view of the lower portion of the heater 10 at track angles of 45° and approaching 90° to the horizontal, respectively. Identical numerals to those used in respect of FIGS. 1 and 2 are utilized in respect of FIGS. 3 to 5. In FIGS. 4 and 5 the level of the fluid 46 at temperatures of 20° and 250° C. are shown. It will be appreciated that whilst the volume occupied by the fluid 46 is a function of the operating temperatures, a range of operating temperatures (in addition to the range of operating angles) can be accommodated by judicious selection of the design of the vapour generator and the amount of fluid stored therein.

It should be appreciated by those skilled in the art that modifications and variations can be made to the embodiments described herein without departing form the scope and spirit of the invention as set forth in the appended claims and their equivalents.

What is claimed is:

1. A vapour phase heater, comprising:

a plurality of elongated hollow heater tracks, said heater tracks having a generally hollow interior;

a vapour generator having a vapour generation chamber in fluid flow communication with said heater track hollow interiors, said heater tracks having a lower end at said vapour generator;

at least one heat input tube disposed in said vapour generation chamber to vaporize a fluid in said vapour generation chamber; and vapour flow connectors disposed in fluid communication between said vapour generator and said heater track hollow interiors, said connectors in communication with said heater tracks at a location longitudinally displaced from said lower end at distance above a level the vaporizer fluid extends into said heater tracks so as to provide a conduit for vapour produced in said vapour generator to pass into said heater track hollow interiors.

2. The vapour phase heater as in claim 1, wherein said vapour flow connectors comprise connection tubes having ends in direct communication with said heater track hollow interiors.

3. The vapour phase heater as in claim 1, wherein said heater tracks are disposed at an angle relative to a horizontal plane less than about 90 degrees.

4. The vapour phase heater as in claim 3, wherein said angle is less than or equal to about 30 degrees.

5. The vapour phase heater as in claim 4, wherein said angle is about 5 degrees to about 10 degrees.

6. The vapour phase heater as in claim 3, wherein said vapour flow connectors are in communication with said heater tracks at a longitudinal location along said heater tracks such that the vaporizable fluid does not extend to said location at any operable angular orientation of said heater tracks within said range of less than about 90 degrees.

7. The vapour phase heater as in claim 1, wherein said heat input tube is located within said vapour generator so as to be continuously covered by the vaporizable fluid, and further comprising a vapour collection space within said vapour generation chamber above the level of the vaporizable fluid, said vapour flow connectors in communication with said vapour collection space.

8. The vapour phase heater as in claim 1, comprising at least two sections, each of said sections having at least one separate said heat input tube, and each said section in fluid flow communication with a different set of said heater tracks.

9. The vapour phase heater as in claim 8, wherein in each of said sections, said heat input tube is located within said vapour generator so as to be continuously covered by the vaporizable fluid, and further comprising a vapour collection space for each said section within said vapour generation chamber above the level of the vaporizable fluid, said vapour flow connectors for each said section in communication with said respective vapour collection spaces.

10. The vapour phase heater as in claim 1, further comprising a gas collection chamber in fluid communication with an end of said heater tracks opposite from said lower end.

11. The vapour phase heater as in claim 10, further comprising a return conduit in fluid communication between said gas collection chamber and said vapour generation chamber.

12. The vapour phase heater as in claim 11, further comprising a vapour trap disposed in said return conduit.

13. The vapour phase heater as in claim 1, wherein said vapour generation chamber comprises a curved wall that converges with said heater track lower ends.

14. The vapour phase heater as in claim 1, wherein each said heater track comprises a front face with thread receiving grooves with remaining faces being insulated.

15. The vapour phase heater as in claim 14, wherein said grooves are spaced apart between about 10 mm to about 12 mm.

16. The vapour phase heater as in claim 1, wherein said heat input tube within said vapour generation chamber comprises a heat distribution wrapping therearound.

17. The vapour phase heater as in claim 16, wherein said heat distribution wrapping is a braided wrapping.

18. The vapour phase heater as in claim 1, comprising a plurality of said heat input tubes arranged in a row adjacent said heater tracks.

19. The vapour phase heater as in claim 1, wherein said heat input tube is configured to receive an electrical heating element insertable through an end of said heat input tube.

20. The vapour phase heater as in claim 1, comprising about four to about 8 of said heater tracks.

21. A vapour phase heater, comprising:

a vapour generator having at least two sections;

each said section having a separate set of elongated hollow heater tracks, said heater tracks having a generally hollow interior;

a vapour generation chamber in each said section in fluid flow communication with said heater track hollow interiors; and each said section having at least one separate heat input tube disposed in said vapour generation chamber to vaporize a fluid in said vapour generation chamber.

22. A vapour phase heater, comprising:

a vapour generator having a vapour generation chamber therein;

at least one elongated hollow heater tracks, said heater track having an end in fluid flow communication with said vapour generation chamber;

at least one heat input tube disposed in said vapour generation chamber to vaporize a fluid in said vapour generation chamber; and wherein surfaces of said heat input tube in said vapour generation chamber are wrapped with a heat distribution material to limit the size of vapour bubbles created on said surfaces.

* * * * *